United States Patent [19]

Grimaldi, Jr.

[11] 4,099,659

[45] Jul. 11, 1978

[54] ADJUSTABLE PNEUMATIC POWER DRIVING APPARATUS

[76] Inventor: David C. Grimaldi, Jr., 458 George St., Ridgewood, N.J. 07450

[21] Appl. No.: 732,805

[22] Filed: Oct. 15, 1976

[51] Int. Cl.[2] ..... B25C 1/04

[52] U.S. Cl. ..... 227/130; 92/120; 173/100

[58] Field of Search ..... 227/130; 92/120, 121; 173/100

[56] References Cited

U.S. PATENT DOCUMENTS

| | | | |
|---|---|---|---|
| 265,950 | 10/1882 | Fitts | 173/100 |
| 3,351,256 | 11/1967 | Readphough | 227/130 |
| 3,673,922 | 7/1972 | Doyle | 227/130 |
| 3,730,044 | 5/1973 | Sawdon | 92/120 |

*Primary Examiner*—Granville Y. Custer, Jr.
*Attorney, Agent, or Firm*—Burns, Doane, Swecker & Mathis

[57] ABSTRACT

This invention relates to an improved pneumatic power driving tool for driving staples, nails and other fasteners. The tool is comprised of a pneumatically operated pivoted rectangular hammer which is used as the means for delivering a force to a ram which in turn drives the fastener. The pressure in an air reservoir provides means for determining the impact of the hammer in this tool. A hammer activated valve is employed to index a fastener before a driving force is applied to the fastener by the hammer.

11 Claims, 5 Drawing Figures

ADJUSTABLE PNEUMATIC POWER DRIVING APPARATUS

BACKGROUND AND SUMMARY OF THE INVENTION

The state-of-the-art of tools utilized for driving nails, staples, joint-fasteners, drive rivets, spring pins and other fasteners has been limited to the use of a force, on a ram, where said force is either applied manually or via a pneumatically operated piston. As a result, for power tools, the force driving the ram is dependent, for a given pneumatic supply pressure, on the surface area of the piston, i.e., large driving forces require large piston areas and vice versa. A consequence of large piston areas is that they cause the physical size of the driving instrument to be large. A primary object of this invention is to provide an apparatus having a pneumatically driven hammer including a steel bar with a generally rectangular cross section and a head fastened crosswise at an end thereof, the hammer being operable to drive a ram.

The pivotally mounted hammer in said pneumatic power driving tool converts angular momentum into a resultant linear impulse on the ram and, thus, applies a linear impulse to the ram which is related to the hammer moment arm or radius. The hammer means thus permits a greatly increased ram power to be developed compared to driving instruments of comparable size utilizing a piston without said hammer means.

A factor limiting the velocity which the said hammer can attain is the air aperture velocity, that is, the velocity of the pressurized air being supplied behind the hammer. The velocity of the pressurized air depends in part upon the size of the aperture and the pressure of the air entering behind the said hammer. Therefore, another object of this invention is the provision of an air reservoir which minimizes the air pressure build up time required when air is released from an orifice and maintains a sufficient volume of air pressure for said hammer to draw upon when said power tool is triggered to drive.

The provisions of a pneumatic driving tool such as have been briefly outlined above and possessing the stated advantages constitute the principal and general objects of the invention.

Another object of this invention is the provision in said power driving tool of a rectangular form for said hammer which permits construction of said driving device so that maximum surface area is available for air pressure to generate a component perpendicular force on said hammer and, thus develop maximum force by the air on said hammer, resulting in an optimum power thrust on said hammer during the power driving cycle of the said invention.

Another object of this invention is to permit the construction of a power driving tool which, by means obtained from said pneumatically driven hammer, has less depth than comparably powered piston driving devices.

Another object of this invention is the provision, by means described above, of a driving device which has less weight than comparably powered piston driving devices.

Another object of this invention is the provision of means whereby many said driving operations can be incorporated in a small tool package.

Another object of this invention is the provision of means whereby the device can index a fastener.

BRIEF DESCRIPTION OF THE DRAWINGS

The detailed description of a preferred embodiment of the invention makes reference to the accompanying drawings wherein like reference indicia are applied to like elements and wherein.

DESCRIPTION OF THE PREFERRED EMBODIMENT

Figure 1:
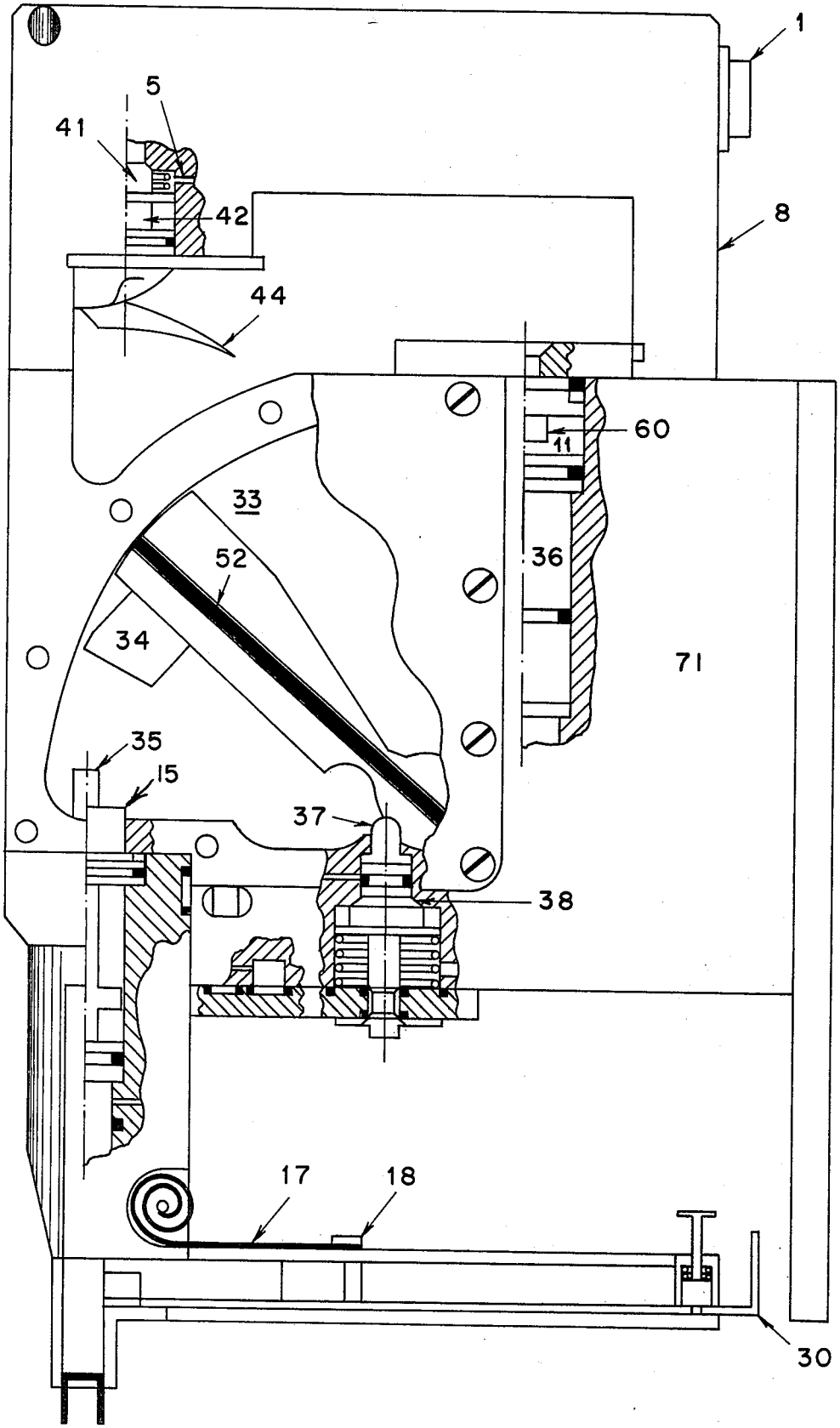
FIG. 1 is a side view of the pneumatic driving apparatus of the present invention with portions broken away in the interest of clarity.

An adjustable power driven apparatus according to the present invention includes (see FIG. 1) a main body portion and a handle 8. The handle 8 includes a trigger 44 which is suitably positioned at one end of the handle to permit operation of the trigger while grasping the handle of the apparatus. A gas fitting 1 is also provided in the handle 8 to enable the apparatus to be connected to a supply of pressurized gas (not shown) such as air, by a conventional hose and coupling (not shown).

Figure 2:
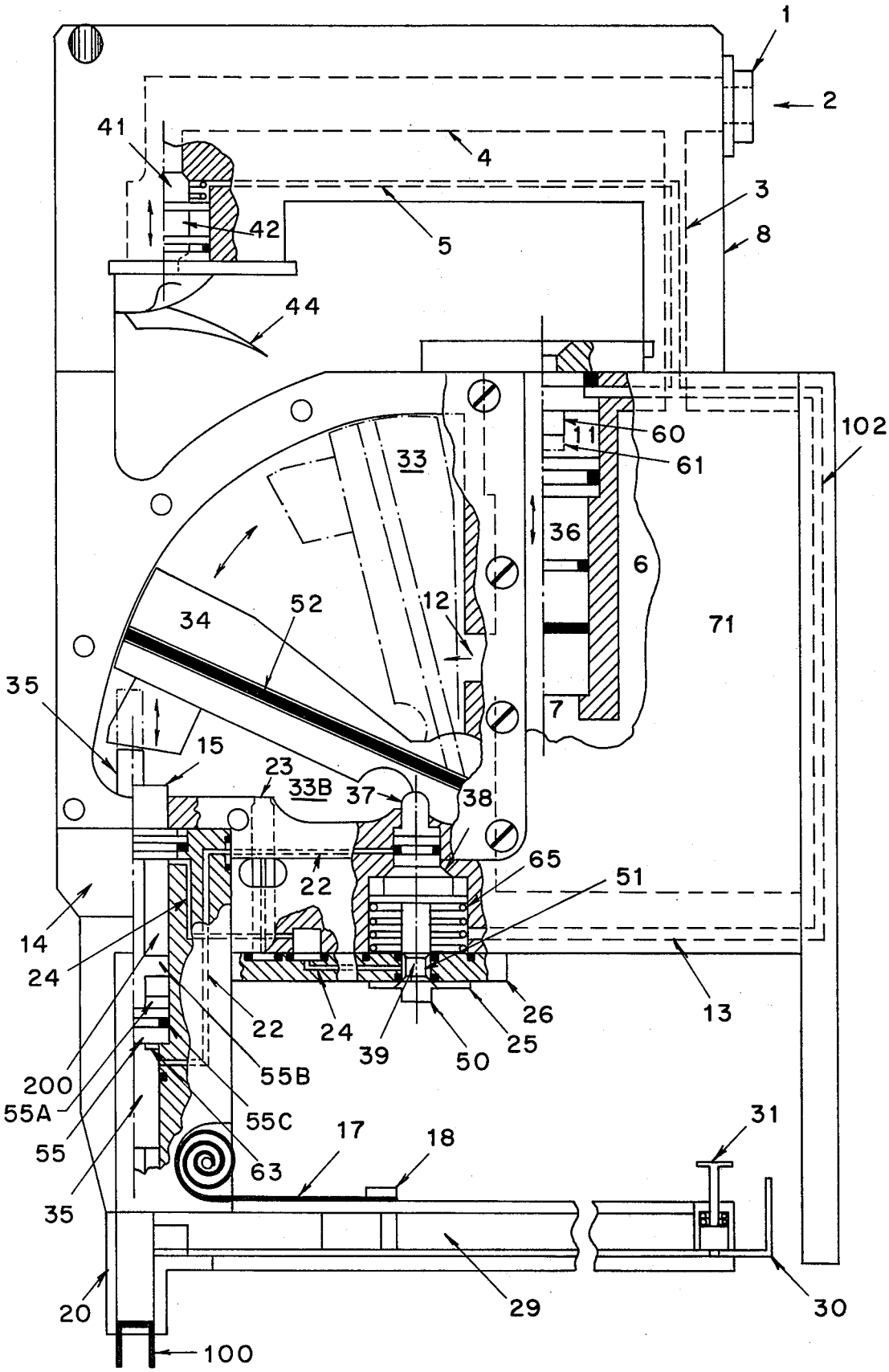
FIG. 2 is a side view of the apparatus with portions broken away in the interest of clarity and showing the hammer in a second position.
Figure 3:
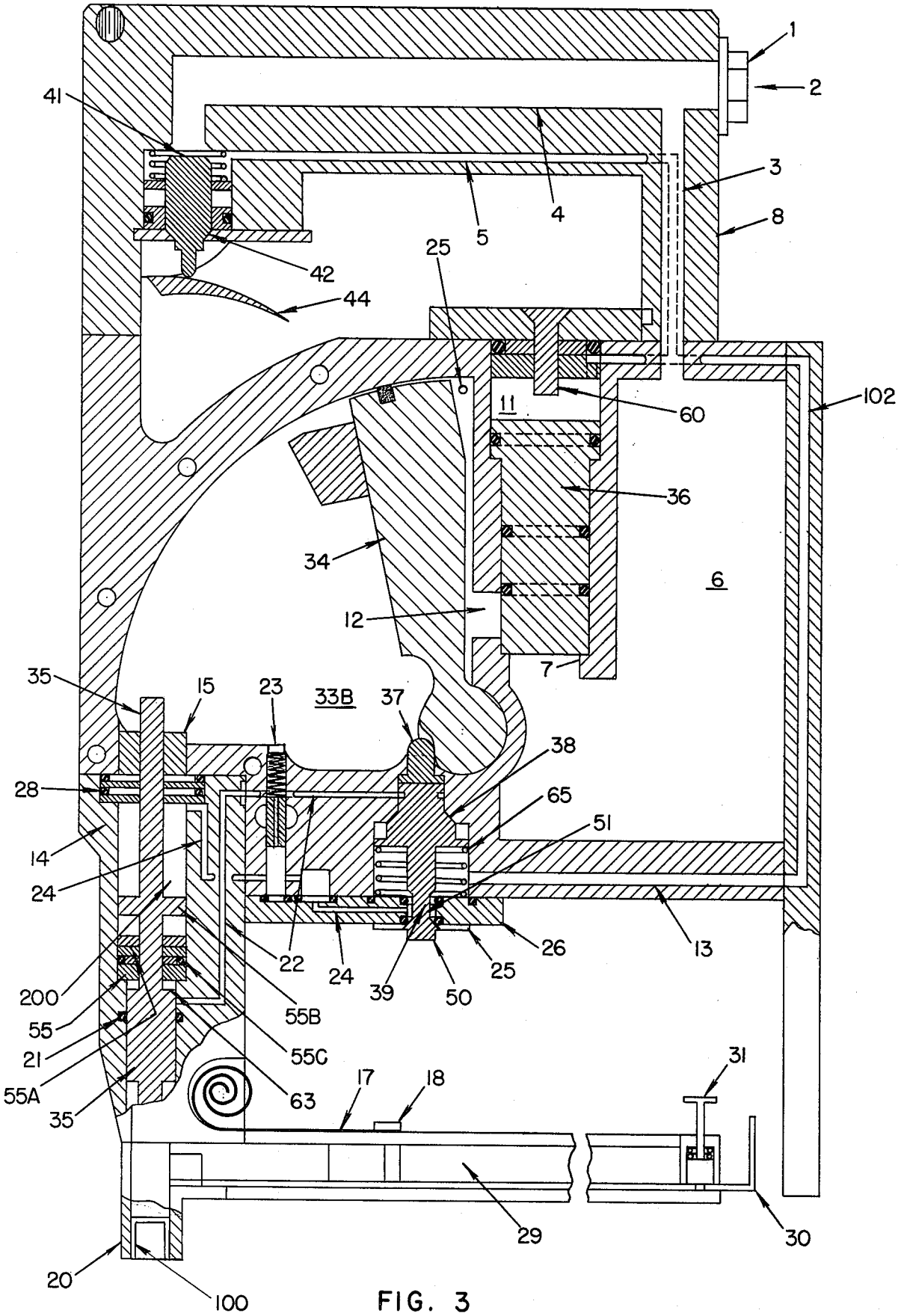
FIG. 3 is a partial cross-sectional view of the pneumatic driving apparatus showing the piston and associated valves in a rest position.

Pressurized gas from the supply enters the gas fitting 1 through an orifice 2 (see FIG. 2) which is in communication with a pair of air supply passageways 3, 4. The trigger 44 controls a poppet valve having a pair of poppet surfaces, 42 which are located at one end of the supply passageway 4. When the trigger 44 is not depressed (see FIG. 3) the poppet is spring-biased to an open position so as to permit communication between the supply passageway 4 and a control passageway 5. At the same time, the poppet is spring-biased closed to prevent a communication between the supply passageway 4, the control passageway 5 and atmospheric pressure.

Figure 4:
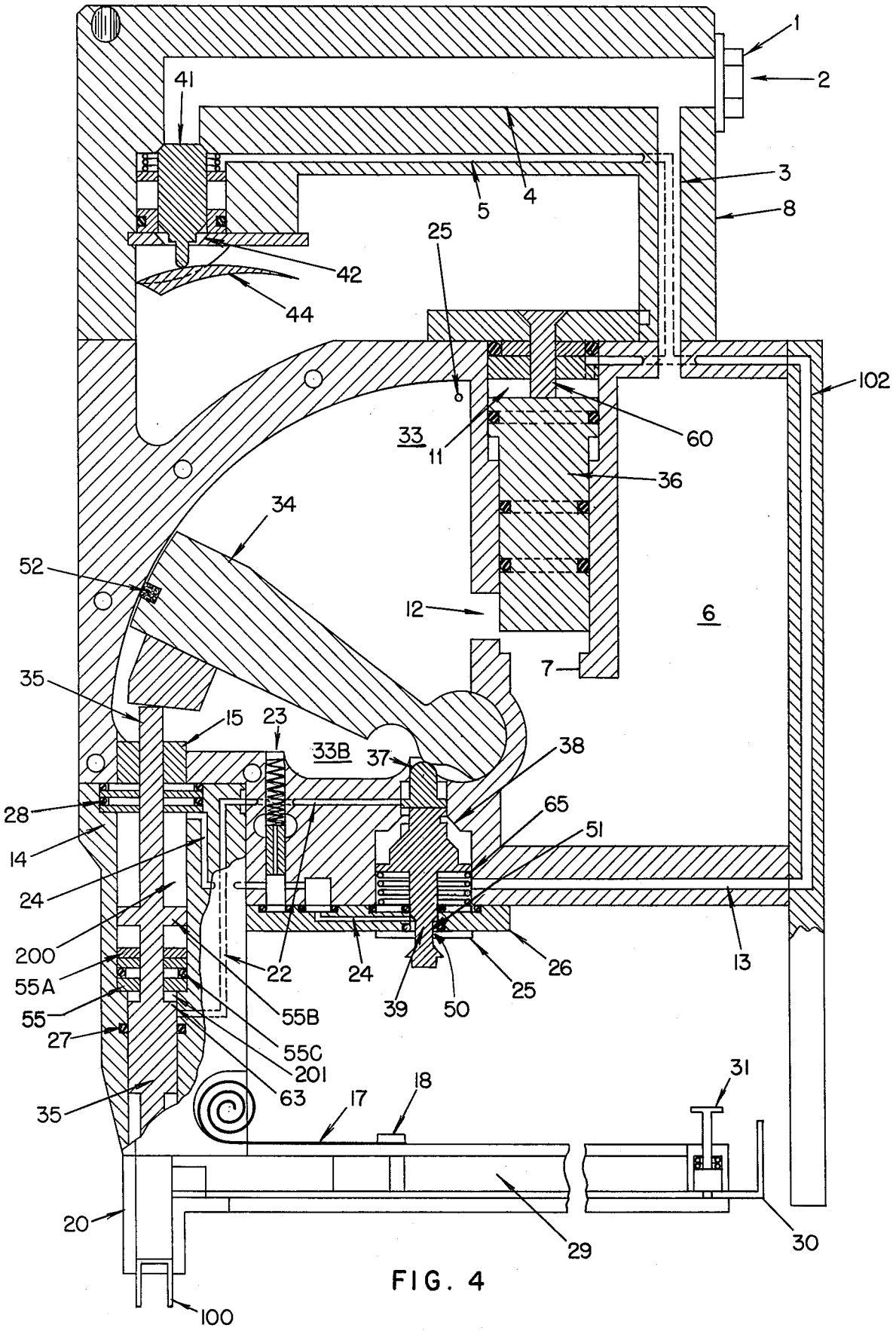
FIG. 4 is a partial cross-sectional view similar to FIG. 3 showing the piston and associated valves when the trigger is depressed.

With reference to FIG. 4, depressing the trigger 44 causes the poppet surface 41 to seal one end of the supply passageway 4 thereby preventing communication between the supply passageway 4 and the control passageway 5. Simultaneously, the poppet surface 42 is opened providing a fluid communication between the control passageway 5 and atmospheric pressure.

The control passageway 5 also communicates both with an air chamber 11 in the body portion and with another control passageway 102. The chamber 11 is located above a differential area piston valve 36 which is mounted in a conforming bore within the body portion of the apparatus. A lower end of the piston valve 36 communicates through an orifice 7 with a supply chamber 6 provided adjacent to the valve 36 and within the body portion. The supply chamber 6 is continuously supplied with pressurized air through the supply passageway 3 which communicates therewith. When pressurized air is supplied simultaneously both to chamber 11 and to orifice 7, the differential area piston valve 36 is urged downwardly to seal one end of a port 12. The port 12 is located adjacent a lower end of the valve 36 and communicates with a first air chamber 33. When the air pressure at the orifice 7 is sufficiently greater than the air pressure in the chamber 11, as when the trigger 44 is depressed venting the chamber 11 to atmospheric pressure, the piston valve 36 is urged upwardly thereby opening the port 12 and supplying pressurized air from the chamber 6 to the first air chamber 33.

With reference again to FIG. 2, an adjustable stop 60 is located at the upper end of the piston valve 36 to limit the maximum upward travel of the valve. The stop 60 may include a threaded portion, or screw, to permit manual adjustment of the stop 60 between the position shown in solid lines and the position shown in phantom lines at 61 to control valve travel. The force applied to a fastener 100 by the apparatus may be varied by changing the length of the adjustable stop 60. The extent of upward travel of the valve 36 determines the size of the opening of the port 12 which in turn determines the rate at which air at supply pressure flows through the port 12 into the first chamber 33.

The air chamber 6 (see FIG. 3), which communicates with the air inlet 2 through the supply passageway 3 has a volume which is sufficient to minimize the period of time necessary to return the air chamber 6 to a desired air pressure, yet still provide a sufficient quantity of air to the port 12 when the piston valve 36 opens. The length of the return time determines how quickly the apparatus will be ready to drive a second or subsequent fastener after driving a first fastener.

The first air chamber 33 which is located in the body portion is defined by a cavity in which a pivotally mounted hammer 34 moves and by a top surface of the movable hammer 34. A small hole 25 which is located in an upper portion of a side wall of the cavity provides an exit passageway for pressurized gas from the first chamber 33 to atmospheric pressure. A second chamber 33B is defined by the cavity. and the hammer 34. The second chamber 33B is located immediately beneath the hammer 34. As more fully described below, when the port 12 opens, pressurized air is supplied to the first chamber 33 to urge the hammer 34 downwardly to strike a ram 35.

The hammer 34 includes a steel bar having a head portion fastened crosswise to one end of the steel bar. The other end of the steel bar is pivotably attached to the main body portion so as to permit a limited angular movement of the hammer. In an extreme upward position (see FIG. 3), the hammer 34 is located in close proximity to the port 12, which results in the first air chamber 33 having a minimum volume. In an extreme downward position (see FIG. 4), the hammer 34 is located at its maximum angular distance away fron the port 12 with the first air chamber 33 accordingly having a maximum volume. To prevent air in the first chamber 33 from leaking around the hammer 34 into the second air chamber 33B, an air seal 52 (see FIG. 2) is provided on the peripheral surface of the hammer 34 in a generally radial arrangement.

At the extreme downward position (see FIG. 4) the hammer 34 strikes the ram 35 and urges the ram 35 downwardly to drive the fastener 100. The ram 35 has a generally rectangular shape at the lower end and includes an upper flange 55B and a lower flange 63. The ram 35 is free to travel up and down in a conforming bore of the main body portion. An upper air seal 28, located adjacent an upper portion of the ram 35, helps to maintain the position of the ram 35 within the bore. A takeup pad 15, located above the air seal 28, limits the downward travel of the hammer 34 while absorbing some of the force exerted by the hammer at the lowermost position of its impulse stroke.

Below the upper flange 55B and above the lower flange 63, a movable pusher 55 is slidably mounted on the ram 35. An O-ring seal 55C surrounds the pusher 55. The pusher 55 cooperates with the upper seal 28 to define an upper air chamber 200 for the ram 35. A lower air seal 27, provided for the lower flange 63, cooperates with the movable pusher 55 to define a lower air chamber 201. A plastic washer 55A is located between the pusher 55 and the upper flange 55B to provide some shock absorption for the ram 35. A fastener indexing means 20 is provided adjacent the lower end of the ram 35 for positioning a fastener 100 beneath the ram 35 in the appropriate location to be driven.

Adjacent the pivot point of the hammer is a control valve having a plunger 37 which is biased by a spring 65 and which includes a poppet surface and a spool 39. The poppet surface 38 controls communication between a control passageway 13 and a passageway 22. Pressurized air is supplied to the control passageway 13 by the control passageway 5 by way of the passageway 102. The spool 39 controls communication between the control passageway 13 and a passageway 24 as well as communication between the passageway 24 and atmospheric pressure through a port 50.

When the hammer 34 is in the extreme uppermost position (see FIG. 3), the plunger 37 is spring biased upwardly with the poppet 38 sealed thereby preventing fluid communication between the passageway 22 and the control passageway 13. Pressurized air in the passageway 13 helps to urge the poppet 38 toward this closed position. In this closed position of the control valve, the spool 39 permits communication between the passageway 13 and the passageway 24 by way of a passageway 51. The port 50, which communicates with atmospheric pressure, is sealed when the plunger 37 is in the uppermost position.

Movement of the hammer 34 to the extreme lowermost position (see FIG. 4), urges the plunger 37 downwardly, thereby opening the poppet 38 to provide fluid communication between the passageway 22 and the passageway 13. Simultaneously, the spool 39 interrupts communication between the passageway 13 and the passageway 24 and vents the passageway 24 to atmospheric pressure by way of the port 50.

The passageway 22 communicates with the air chamber 201 located beneath the pusher 55; whereas the passageway 24 communicates with the air chamber 200 located above the pusher 55 and with the second air chamber 33B, by way of an air passageway 23. The passageway 23 also serves as an exit passageway for the air chamber 33B when the hammer is moving toward the ram 35.

Fasteners are supplied to the apparatus by a magazine 29 which is located at a lower end of the main body portion adjacent the ram 35. A coil spring 17 and a spring holder 18 are connected to a fastener pusher 30 to urge a supply of fasteners toward ram 35.

In operation, the apparatus is initially in the rest position (see FIG. 3) with the trigger 44 released. The poppet surface 41 is open with pressurized air being supplied both to the chamber 11 through the control passageway 5 and to the chamber 6 through the supply passageway 3. Because of the greater surface area at the top of the piston valve 36 relative to the bottom, the piston valve 36 is urged downwardly to seal the port 12.

With the poppet surface 41 open, pressurized air is being supplied to the three passageways 5, 102 and 13. Communication between the passageway 13 and the passageway 22 is interrupted by the sealed poppet 38. The spool 39 permits communication, however, between the passageway 13 and the passageway 24, thereby supplying pressurized air both to the chamber 200 and to the second chamber 33B. The pressurized air in chamber 200 maintains the ram 35 in a downward position while the air chamber 33B acts to maintain the hammer 34 in the uppermost position. Finally, the spool 39 prevents a passage of pressurized air through the passageway 50 to atmospheric pressure.

With reference now to FIG. 4, a fastener is driven by first depressing the trigger 44 which seals the poppet surface 41 thereby preventing communication between the supply passageway 4 and the control passageway 5. Simultaneously, the poppet surface 42 opens to vent the chamber 11 to atmospheric pressure through the control passageway 5 which causes the piston valve 36 to move upwardly toward the adjustable stop 60. The upward movement of the piston valve 36 opens the port 12 thereby permitting a flow of pressurized air from the chamber 6 into the first chamber 33 to urge the hammer 34 downwardly toward the ram 35 while air in chamber 35B exhausts through the passageway 23.

Venting of the control passageway 5 also results in a venting to atmospheric pressure of the passageways 102, 13. The chamber 200 and the second chamber 33B are thereby vented to atmosphere through the associated passageways 24, 23. Downward movement of the hammer 34 depresses the plunger 37 to open the poppet 38 and vent the chamber 201 through the passageways 22 and 13 to atmospheric pressure.

At its lowermost position, the hammer 34 strikes the ram 35 to drive the fastener 100 downwardly. The hammer 34 is limited in its downward travel by the take-up pad 15 and eventually comes to rest above the pad. While the trigger 44 is still depressed, chambers 33B, 200 and 201 are each vented to atmospheric pressure. The downward travel of the plunger 37, however, due to the movement of the hammer 34, positions the spool 39 so as to prevent communication between the passageway 24 and the passageway 13. The chamber 200 is now vented to atmospheric pressure more directly through the port 50 by way of the passageway 24.

Figure 5:
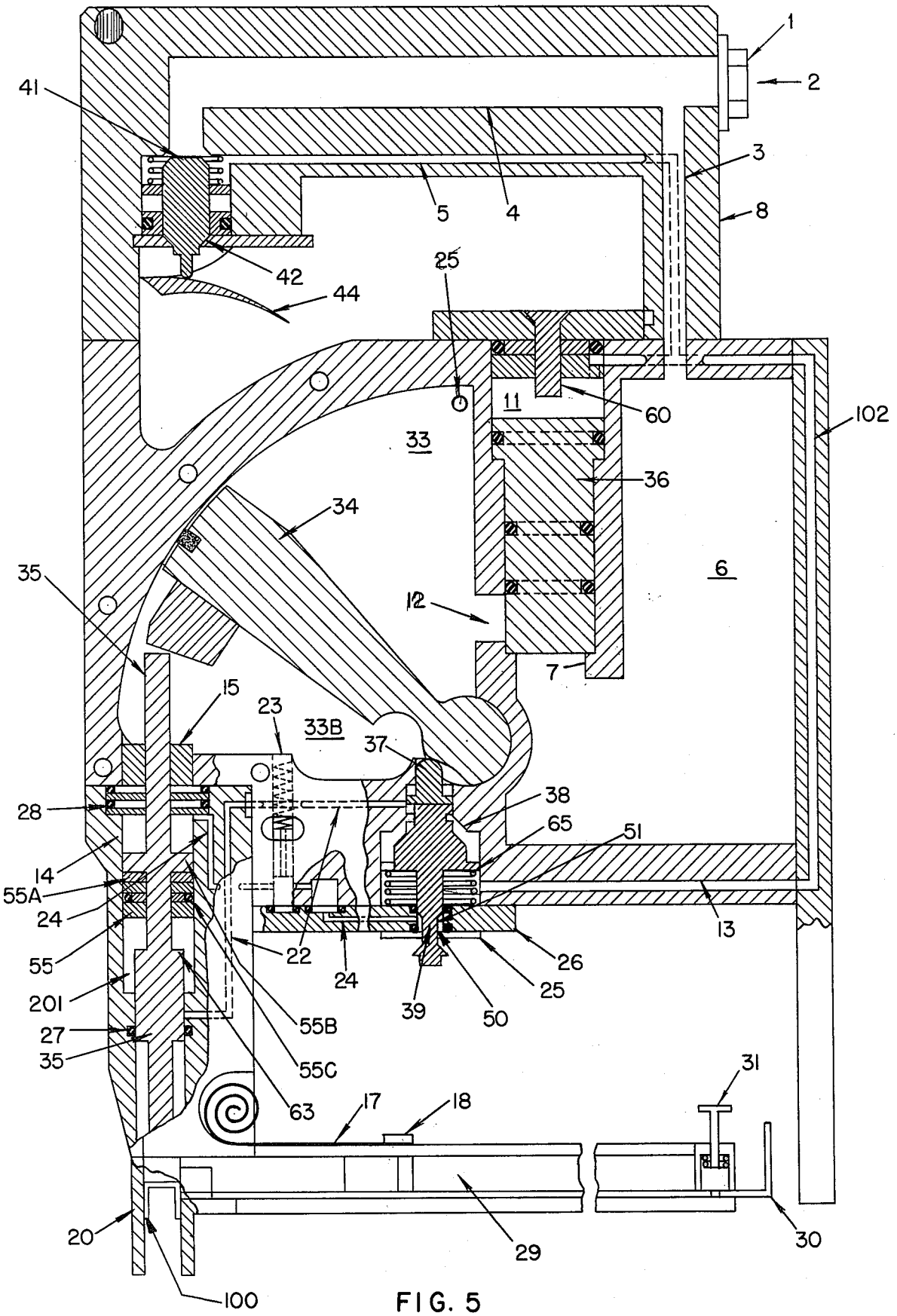
FIG. 5 is a partial cross-sectional view similar to FIG. 3 showing the piston and associated valves immediately after the trigger has been released.

When the fastener has been driven (see FIG. 5), the trigger 44 is released to permit the spring bias to again seal the poppet surface 42 and open the poppet surface 41. Pressurized air is supplied to the chamber 11 by way of the control passageway 5 which moves the valve 36 downwardly and seals the port 12. Simultaneously, pressurized air is supplied to the passageways 102 and 13 by way of the control passageway 5. Since the hammer is still at the lowermost position, the poppet surface 38 is open, permitting communication between the passageway 13 and the chamber 201 by way of the passageway 22. Consequently, pressurized air enters the chamber 201 and causes the pusher 55 to urge the ram 35 toward its uppermost position. In turn, the ram 35 urges the hammer 34 upwardly. To completely return the hammer 34 to its uppermost position, pressurized air passes through the valve 39 (see FIG. 3) into the passageway 24, the passageway 23 and into the second air chamber 33B. While the ram 35 is in the uppermost position, a new fastener 100 is indexed beneath the ram 35 by the nosepiece 20.

Upward movement of the hammer 34 permits the plunger 37 to move upwardly, eventually closing the poppet 38 which prevents communication between the chamber 201 and the passageway 13. In the upward position, the spool 39 permits communication between the passageway 24 and the passageway 13 while closing communication of the passageway 24 with atmospheric pressure through the port 50. The supply of pressurized air to the passageway 24 causes the pusher 55 to urge the ram 35 downwardly to the initial or rest position (see FIG. 3).

With the hammer 34 in the uppermost position and the ram 35 lowered, the apparatus is again in the initial, or rest, position and ready to drive another fastener 100 downwardly when the trigger 44 is depressed.

The apparatus can be used to drive nails, staples, rivets, joint fasteners, spring pins and other fasteners by adapting the ram, nosepiece, and magazine of the apparatus to accommodate the selected fastener. Finally, the apparatus may be utilized as a punch press by adapting the ram to drive an appropriate punch.

The present invention may thus be embodied in other specific forms without departing from the spirit or essential characteristics thereof. The presently disclosed embodiment is, therefore, to be considered in all respects illustratively and not restrictively. The scope of the invention is determined by the appended claims rather than by the foregoing description with all variations falling within the meaning and range of equivalency of the claims intended to be embraced thereby.

What is claimed is:

1. Pneumatically powered apparatus for driving fasteners such as staples, nails, rivets, joint fasteners, spring pins and the like, comprising:

a housing having a reservoir for pressurized air and a first chamber;

hammer means for developing power, provided in the first chamber movable between a first position and a second position, and pivotally mounted in the housing;

ram means for transmitting power from the hammer means to a fastener, positioned adjacent the second position of the hammer means, and being movably mounted in the housing to be struck by the hammer means for driving a fastener; and means for admitting pressurized air from the reservoir to the first chamber for moving the hammer means from the first position to the second position.

2. The apparatus of claim 1 wherein the hammer means includes a hammer having a bar pivotably attached at one end to the housing and a head fastened crosswise to another end of the bar, the hammer having a rectangular cross section with a sealing member provided about substantially an entire periphery of the hammer.

3. The apparatus of claim 1 further comprising:

fastener indexing means provided adjacent the ram means for positioning a fastener beneath the ram means.

4. The apparatus of claim 1, wherein said ram means includes a ram having first and second flange portions, and a ram pusher member slidably movable on the ram and located between the first and second flange portions.

5. The apparatus of claim 4 further comprising:

valve means provided adjacent the hammer means and operable by the hammber means for selectively supplying pressurized air to either side of the ram pusher member.

6. The apparatus of claim 5 wherein the valve means includes a spring-biased plunger, a poppet valve surface and spool valve.

7. The apparatus of claim 5 wherein said means for admitting pressurized air from the reservoir to the first chamber includes a differential area piston valve.

8. The apparatus of claim 7 wherein said means for admitting pressurized air from the reservoir to the first chamber further includes an adjustable stop provided adjacent the differential area piston valve.

9. The apparatus of claim 7 further comprising:

trigger operated valve means for selectively supplying pressurized air to one side of the differential area piston and to one side of the ram valve means, the trigger operated valve means being provided in the apparatus in fluid communication with the one side of the differential area piston and with the one side of the ram valve means.

10. The apparatus of claim 5 wherein the ram valve means selectively supplies pressurized air to the first chamber for moving the hammer means from the second position to the first position.

11. Pneumatically powered apparatus for driving fasteners such as staples, nails, rivets, joint fasteners, spring pins and the like, comprising:

a housing having a reservoir for pressurized air and a first chamber;

a hammer pivotally mounted within the first chamber of the housing and movable between a first position and a second position, the hammer having a sealing member provided about substantially an entire periphery thereof, thereby dividing the first chamber into an upper portion located above the hammer and a lower portion located below the hammer;

a differential area piston valve located adjacent the reservoir and the first chamber and operable between a first closed position preventing communication between the reservoir and the upper portion of the first chamber and a second open position permitting communication between the reservoir and the upper portion of the first chamber;

a ram having first and second flange portions, located adjacent the second position of the hammer, the ram being movably mounted in the housing to be struck by the hammer and driven between first and second positions for driving a fastener;

a ram pusher member slidably mounted on the ram between the first and second flanges;

a ram valve including a spring-biased plunger, a poppet valve and a spool valve provided adjacent the hammer and operably by the hammer for selectively supplying pressurized air to either side of the ram pusher member;

a trigger operated valve provided in the housing and having first and second poppet surfaces for selectively supplying pressurized air to one side of the differential area piston valve and to one side of the ram valve; and a fastener indexing member provided adjacent the ram for positioning a fastener beneath the ram.

* * * * *